United States Patent [19]

Stäbler et al.

[11] Patent Number: 4,973,807

[45] Date of Patent: Nov. 27, 1990

[54] ACTUATION DEVICE FOR A SWITCH PARTICULARLY FOR A HAND MACHINE TOOL

[76] Inventors: Manfred Stäbler, Christophstr. 45; Walter Barth, Römerstr. 2; Winfied Helm, Gotenstr. 10, all of 7022 Leinfelden-Echterdingen, Fed. Rep. of Germany

[21] Appl. No.: 877,434

[22] Filed: Jun. 23, 1986

[30] Foreign Application Priority Data

Aug. 10, 1985 [DE] Fed. Rep. of Germany ..... 3528741

[51] Int. Cl.[5] ..... H01H 23/00

[52] U.S. Cl. ..... 200/321; 200/43.17; 200/330; 200/332; 200/332.1; 200/337; 200/338

[58] Field of Search ..... 200/321, 322, 157, 318, 200/330, 331, 332, 335, 337, 328, 291, 43.16, 43.17, 328, 338, 293.1, 318.1

[56] References Cited

U.S. PATENT DOCUMENTS

| | | | |
|---|---|---|---|
| 1,592,225 | 7/1926 | Pieper | 200/157 |
| 3,806,685 | 4/1974 | Seeger, Jr. et al. | 200/329 |
| 3,854,020 | 12/1974 | Glover et al. | 200/321 |
| 3,886,341 | 5/1975 | Forrest | 200/328 |
| 4,132,873 | 1/1979 | Vanderpool | 200/318 X |
| 4,331,844 | 5/1982 | Saitoh | 200/16 R |
| 4,376,240 | 3/1983 | Stuart | 200/322 |
| 4,380,693 | 4/1983 | Kuhlman et al. | 200/330 |

FOREIGN PATENT DOCUMENTS

| | | | |
|---|---|---|---|
| 3023691 | 1/1982 | Fed. Rep. of Germany | 200/330 |
| 992792 | 10/1951 | France | 200/337 |
| 649986 | 11/1960 | Italy | 200/328 |

*Primary Examiner*—Ernest G. Cusick

[57] ABSTRACT

An actuation device for a switch of a hand machine tool, particularly for a Totmann switch which provides for fatigue-free operation. The actuation device includes a front wall provided with a locking projection engageable in a recess formed in the wall of the switch housing. A restoring spring acts on an actuation member. Two spaced ribs with inclined surfaces are provided on the housing wall. The locking projection slides along the inclined surfaces of the spaced ribs. The locking projection may be broken away from the front wall of the actuation member whereby the end of the front wall would slide along the inclined surfaces of the ribs.

5 Claims, 1 Drawing Sheet

ACTUATION DEVICE FOR A SWITCH PARTICULARLY FOR A HAND MACHINE TOOL

BACKGROUND OF THE INVENTION

The present invention relates to an actuation device for a switch, particularly of a hand-held machine tool, of the type wherein an actuation member is displaceable by hand in the direction of switching of the switch.

An actuation device of the foregoing type has been disclosed in DE-OS No. 30 23 691. This conventional device has various disadvantages. The actuation means of this known actuation device rests at the end of its switching-on path in the arresting or locking end position with the support of a restoring spring, and the action of the restoring spring is retained in that end position. The switch remains in the switching-on position unless at the end of actuation the locking connection between the actuation means and its guide, for example the housing of the machine tool, is released. Such actuation devices are not, however suitable for use with so-called Totmann switches, the actuation-means of which must be released when the switch can be put to the switching-off position. On the other hand, known Totmann switches are disadvantageous because during the entire switching-on process they must be held in the switching-on position against the action of the restoring spring. For a reliable restoring position, the force of the restoring spring must be so great that the actuation end with the actuation means locked becomes quickly exhausted. This can lead to a non-observed switching-off of the hand machine tool. The actuation end must be subject to resting interruptions which are not required under other operation loads. A further difficulty for a designer of switch actuating devices of hand machine tools resides in that for some types of such machine tools, the actuation means has been utilized which was released only from its switching-on position whereas for other types of the machine tools only the Totmann function has been required. These actuation devices have been therefore manufactured for various purposes and kept in storage. This makes manufacturing and storing of the actuation devices rather difficult.

SUMMARY OF THE INVENTION

It is an object of the present invention to provide an improved actuation device for a switch of a hand machine tool.

It is a further object of the invention to provide an actuation device which can be utilized with a Totmann switch, which would be practically fatigue-free in the switching-in position.

These and other objects of the invention are attained by an actuation device for a switch, particularly for a hand machine tool, comprising a tiltable means actuation displaceable in a direction of switching-on of the switch, wherein a switching-on position of the switch is tiltable in a retaining position and the actuation means is returnable to a switching-off position by a force of a restoring spring, an axis of tilting of the actuation means being positioned in a plane between a point of contact of the restoring spring and gripping surfaces for an operation of said actuation means so that the restoring spring acts on the actuating means in said retaining position in a tilting manner, housing wall means provided on a housing of the machine tool and cooperating with said actuation means, said wall means being inclined in the direction of switching-on of the switch so that a front end (18) of said actuation means as viewed in said direction can be supported on said wall means so that said wall means can not hold in the switching-on position said actuation means released at an operator end, against the force of said restoring spring.

It appears that the best results could be obtained with the actuation device according to the invention when it is applied to a Totmann switch. Due to the provision of slope wall means a slight pressure on the actuation means in the direction transverse to the direction of switching-on, is sufficient to maintain the switch in the switching-on position. A required retaining force can be thus varied by the selection of the inclination of the slope wall means.

The slope wall means may include two ribs spaced from each other and each having an inclined surface, said housing having a locking recess formed between said ribs and before the latter, said actuation means including a locking projection which is engageable and lockable in said locking recess.

The front edge of said slope wall means and a rear edge of said locking recess lie in the same plane.

The locking projection may have a cutoff at a root thereof. This can be obtained by simply breaking the locking nose away. If the switch is utilized for the Totmann function the locking projection on the actuation means can be simply broken away. The actuation means cooperates with the ramp means. The locking projection remains on the actuation means in the on-position until it is released by the restoring spring.

The ramp means may be provided with at least one transverse groove which has the width which is smaller than the thickness of a front supporting wall of said actuation means so that said front supporting wall, during a return movement of said actuation means, can slide over said transverse groove.

The actuation end applies, perpendicular to the direction of action of the restoring spring, a portion of the force of this spring reduced by friction losses on the inclined surfaces of the ribs.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
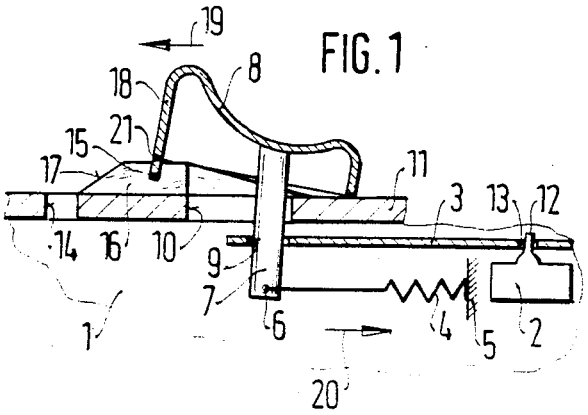
FIG. 1 is a sectional view through an actuation device with an actuation member provided with a locking projection, according to the invention.
Figure 2:
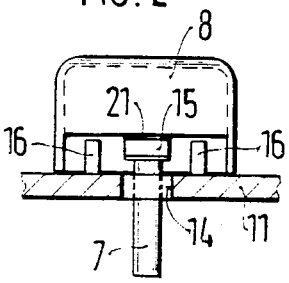
FIG. 2 is a side view of the device of FIG. 1.

Referring now to the drawings in detail, and firstly to FIGS. 1 and 2 thereof, a switch 2 is positioned in a housing 1 of a hand-held machine tool. The housing 1 further receives a rod 3, a tension spring 4 and a support 5 of the tension spring. In a bore 6 of a follower or carrier pin 7 of an operating or actuating member 8, is engaged a free end of the tension spring 4. At the end of the rod 3, facing away from the switch 2, is provided a recess 9 through which the follower pin 7 can extend. The follower pin 7 further projects through a guide slot 10, provided in a housing wall 11, on the outer surface of which is positioned the actuating member 8. A switch finger 12 of the switch 2 is engaged in a recess 13 provided at the switch-side end of the rod 3.

A locking opening or recess 14 is formed in the housing wall 11, in which recess the locking projection 15 of the actuating member 8 can be engaged. At the both sides of the guide slot 10 and also at the locking recess 14, are arranged ribs 16 which have each a slope 17 which is inclined in the direction of switching of the switch 2. Both ribs 16 are overlapped by the actuation member 8 which in the direction toward the housing wall 11 is hollow. The front wall of the actuation member 8 is indicated as a support wall 18 because by means of this wall the actuation member 8 is supported on the ribs 16.

In the embodiment illustrated in FIGS. 1–4 the supporting wall 18 is supported on ribs 16 in the switch-on position which is shown in FIG. 1. The supporting wall 18, upon the displacement of the actuation member 8 in the direction of switching-on of the switch (arrow 19), slides over the ribs 16 and their slopes 17 until the locking projection 15 of the actuation member 8 according to FIGS. 1 and 2 comes into contact with the outer surface of the housing wall 11 and slides over that wall into the locking opening or recess 14. Recess 14 has one of its edges lying in the same plane with a front edge of slopes 17 of ribs 16 as seen from FIG. 1. In the counter direction indicated by arrow 20 the drawn tension spring supports the locking or arresting movement by a tilting torque produced thereby. This, tilting torque also causes the tension spring 4 to hold the locking projection 15 in engagement with the locking opening 14 until the end of actuation releases this locking connection by pressing the end of the actuation member 8, opposite to the supporting wall 18. FIGS. 1 and 2 illustrate this mode of operation of the actuation device of FIGS. 1–4.

Figure 3:
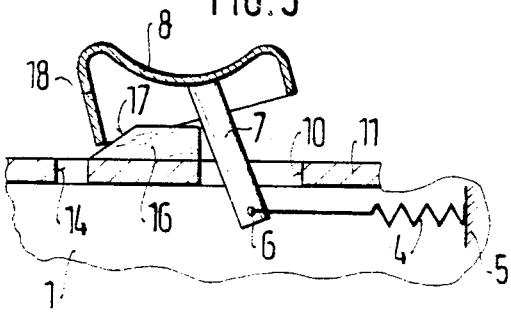
FIG. 3 is a sectional view through the actuation device with an actuation member with the locking projection broken away therefrom.
Figure 4:
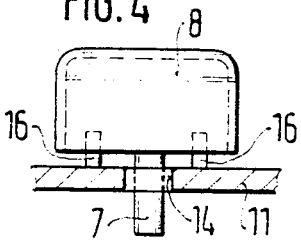
FIG. 4 is a side view of the device of FIG. 3.

The similar embodiment with the actuation member 8 according to FIGS. 3 and 4 operates as a Totmann switch. The switch and the connecting structure are ommitted from FIGS. 3 and 5 for the sake of clarity. With the provision of a groove or cutout 21, the locking projection 15 is cut off at its bottom. In the switch-on position of the so-modified actuation member 8, the supporting wall 18 lies on the slopes 17. The traction of the tension spring 4 does not allow the actuation member 8 to be pulled over the slopes 17 and the remaining regions of ribs 16 as long as at the end of the user the actuation member is pressed toward the housing wall 11. The force which is necessary for the application of this pressure perpendicular to the switching movement, is substantially smaller than the force which can be overcome directly by the tension spring 4. This force depends upon the angle of inclination of slopes 17 and the friction coefficient for friction between the abutment surface of the supporting wall 18 and the oblique surface of the slopes 17. If this pressure on the actuation member 8 is reduced (FIG. 3) the tension spring pulls the actuation member over the slopes 17 and the remaining portions of ribs 16 back to the switching-off position of the switch finger 12 of the switch 2.

Figure 5:
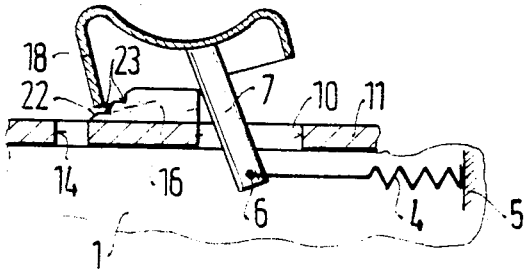
FIG. 5 is a sectional view of the actuation device of the other embodiment of the invention.

In the embodiment of FIG. 5 the construction of the actuation device is the same as that of FIGS. 1–4, with the exception of slopes 22 of ribs 16. The actuation member 8 shown in FIG. 5 has the arresting projection 15 broken away. The slopes 22 have two transverse grooves 23 which are narrower than the thickness of the supporting wall 18. When the embodiment of FIG. 5 is utilized as a Totmann switch the inner edge of the supporting wall 18 is in engagement with one of the transverse grooves 23 as long as pressure is applied by a user to the actuation member in the normal direction. Thereby a necessary holding force is even smaller than that in the case of FIG. 3 because only a tilting torque should be overcome. If pressure applied to the actuation member 8 is reduced this actuation member tilts under the traction force of the tension spring 4 about the lower end of the supporting wall 18 until the sharp inner edge of the supporting wall is lifted away from the transverse groove 23, in which it was engaged. Then the supporting surface of the wall 18 slides away unobstructively over the slopes 17. The switch finger 12 of the switch 2 is also brought to its switching-off position.

It will be understood that each of the elements described above, or two or more together, may also find a useful application in other types of actuation devices for switches differing from the types described above.

While the invention has been illustrated and described as embodied in an actuation device for a switch of a hand-held machine tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In an actuation device for a switch for a machine tool, particularly a hand tool, comprising an actuation means having a front end and displaceable from a switching-off position to a switching-on position in which said switch is switched on; and a restoring spring having a point of contact with said actuation means, said actuation means also having a retaining position and being tiltable from said switching-on position to said retaining position, and the actuation means being returnable to a switching-off position by a force of said restoring spring, said actuation means having a gripping surface for an operator and an axis of tilting which is positioned in a plane between said point of contact and said gripping surface so that the restoring spring acts on the actuating means in said retaining position to bias said actuation means opposite said switching-on position, the improvement comprising a housing of the machine tool including slope wall means which cooperate directly with said actuation means, said slope wall means being inclined in the direction of switching-on of the switch so that said front end (18) of said actuation means, as viewed in said direction, can be supported on said slope wall means so that said slope wall means can not hold said actuation means in the switching-on position against the force of said restoring spring when said actuation means is released by the operator.

2. The device as defined in claim 1, wherein said slope wall means included two ribs spaced from each other and each having an inclined surface, said housing having a locking recess formed between said ribs, said actuation means including a locking projection which is engageable and lockable in said locking recess.

3. The device as defined in claim 2, wherein said slope wall means has a front edge and said recess has edges, said front edge of said slope wall means and one edge of said locking recess lying in the same plane.

4. The device as defined in claim 2, wherein said locking projection has a cutoff at a bottom thereof.

5. The device as defined in claim 1, wherein said slope wall means is provided with at least one transverse groove which has a width which is smaller than a thickness of a front supporting wall of said actuation means so that said front supporting wall during a return movement of said actuation means can slide over said transverse groove.

* * * * *